United States Patent [19]

Sheets

[11] Patent Number: 4,793,514

[45] Date of Patent: Dec. 27, 1988

[54] CAP FOR INVERTED WATER BOTTLE

[76] Inventor: Kerney T. Sheets, P.O. Box 771, Duplessis, La. 70728

[21] Appl. No.: 49,531

[22] Filed: May 14, 1987

[51] Int. Cl.[4] ..... B67D 5/08; B67D 3/00

[52] U.S. Cl. ..... 222/67; 222/481.5; 222/482; 137/433; 62/397

[58] Field of Search ..... 222/67, 481, 481.5, 222/325, 181, 482, 442; 137/433, 454; 141/198, 199, 301, 303; 62/397

[56] References Cited

U.S. PATENT DOCUMENTS

| | | | |
|---|---|---|---|
| 962,529 | 6/1910 | Rose | 62/397 X |
| 1,250,941 | 12/1917 | Baer | 62/397 X |
| 1,287,141 | 12/1918 | Travis | 222/442 |
| 1,489,754 | 4/1924 | Fruen | 222/482 X |
| 1,875,539 | 9/1932 | Wolfe | 62/397 X |
| 1,973,392 | 9/1934 | Rock | 62/397 X |
| 2,020,884 | 11/1935 | Garcia | 62/397 X |
| 2,313,954 | 3/1943 | Mariani | 62/397 X |
| 2,320,128 | 5/1943 | Hall | 222/67 X |
| 2,343,847 | 3/1944 | Swann | 222/442 X |
| 2,645,401 | 7/1953 | Kerr | 222/447 X |
| 2,808,182 | 10/1957 | Furedi | 222/479 X |
| 3,848,776 | 11/1974 | Schieser | 222/181 X |

FOREIGN PATENT DOCUMENTS 298754 10/1928 United Kingdom ..... 222/67

*Primary Examiner*—Charles A. Marmor
*Assistant Examiner*—Gregory L. Huson
*Attorney, Agent, or Firm*—David L. Ray

[57] ABSTRACT

A closure assembly for conveying air to the interior of an inverted water bottle and for conveying water from the interior of an inverted water bottle having a downwardly pointing spout including a closure connectable to the spout of a water bottle, the closure having an opening therein through which water may flow from the inverted water bottle, a hollow cylinder having an open first end and a partially closed second end, the first end being connected to the closure, the second end being located in the interior of the water bottle and having an air inlet for conveying air from the interior of the hollow cylinder to the interior of the water bottle, the second end having a water inlet for conveying water from the interior of the inverted water bottle to the interior of the cylinder the closure having an opening therein in alignment with first end of the hollow cylinder, and a float slidably received in the cylinder for sealing the water inlet.

9 Claims, 7 Drawing Sheets

CAP FOR INVERTED WATER BOTTLE

BACKGROUND OF THE INVENTION

1. Field of the Invention

The present invention is related to a closure assembly for placement on an inverted water bottle such as those commonly used for containing and dispensing mineral water or purified water for human consumption. In particular, the present invention is related to a closure assembly for preventing air entering the water bottle from bubbling upward through the bottled water and causing contamination of the water and flexing of the walls and bottom of water bottles made from flexible material such as plastics. Another embodiment of the invention is related to a valve for preventing an inverted water bottle having a hole in the lower end thereof from draining into a water cooler. An additional embodiment of the invention is related to a closure which prevents water from flowing from an inverted bottle which is being placed on a water cooler.

2. Background of the Invention

Both glass and plastic water bottles are well known in the art. Water coolers commonly utilize inverted water bottles to provide mineral water or distilled water in areas where drinking water may not be of the desired purity. A conventional water cooler commonly has an open top and a water containing reservoir in which a bottle is placed after inverting the bottle. The water in the reservoir rises as water flows from the bottle to form a seal with the spout of the bottle when the water level in the reservoir reaches the spout, thereby stopping the flow of water from the bottle. The reservoir is cooled by a refrigeration unit, ice or the like contained in the cooler.

When withdrawing water from the bottle it is necessary to allow air to enter the spout of the bottle in order for the water to be withdrawn from the bottle. Commonly when the water level in the reservoir drops beneath the surface of the spout of the bottle, air then bubbles upwardly through the distilled or purified water as water pours from the bottle into the reservoir. As the air bubbles upwardly through the bottle, impurities in the air are absorbed by the water, thus causing some contamination of the water depending upon the degree of contamination of the air. In locations such as office buildings and hospitals, there may be many impurities in the air which can contaminate the purified drinking water. Thus, it is desirable to provide a way to introduce air into the interior of a water bottle without bubbling the air upward through the water.

A further problem associated with inverted plastic water bottles is the fatigue failure of the bottom of the bottles caused by air bubbles. When air is bubbled upwardly in a conventional plastic water bottle, the bottom of the inverted bottle flexes upwardly and downwardly with each bubble. Continual flexing of the bottom of the bottle causes fatigue failure in the plastic material from which the water bottle is constructed, especially if there is a small indentation in the bottle or a split, cut or crack caused by handling or dropping a full bottle of water prior to loading the bottle in a machine. It is thus desirable to introduce air into the interior of the bottle in a smooth and continuous manner without causing the bottle of the bottle to flex due to bubbles entering the bottle.

Another problem encountered with inverted plastic water bottles is leakage of the bottles caused by a crack at some point in the bottle which causes air to enter the interior of the bottle. Such leakage from the bottle can be very expensive due to water damage of the floor and/or carpets surrounding the water cooler.

Still another problem encountered with inverted plastic water bottles is the spillage that occurs while the bottle is being placed in the cooler. Such spillage while the bottle is inverted can wet the area around the cooler and the person installing the bottle.

Thus, it is an object of the invention to provide an apparatus for introducing air into the interior of an inverted water bottle without bubbling air upward through water in the bottle.

It is another object of the present invention to introduce air into the interior of an inverted water bottle in a continuous manner which will not cause flexing of the bottom of the bottle.

It is further object of the present invention to prevent all of the water from flowing from an inverted water bottle when a crack or hole is formed in the bottom of the bottle allowing air to enter the bottle.

It is an additional object of the invention to prevent water from flowing from an inverted water bottle as it is being installed in a bottled water cooler.

SUMMARY OF THE INVENTION

In accordance with the present invention there is provided a cap assembly for conveying air to the interior of an inverted water bottle having a downwardly pointing spout including a closure connectable to the spout of the water bottle, an air tube connected to the closure for conveying air from the outside of the closure to the inside of the water bottle, the air tube extending above the closure and terminating in the interior of the bottle above the water level in the bottle, and a water tube for conveying water from the inside of the bottle to the outside of the bottle. There is also provided a float valve assembly connectable to the closure of the present invention for preventing water from flowing from a water bottle having a hole in the portion thereof between the spout and the bottom of the bottle.

DESCRIPTION OF THE PREFERRED EMBODIMENTS

Figure 1:
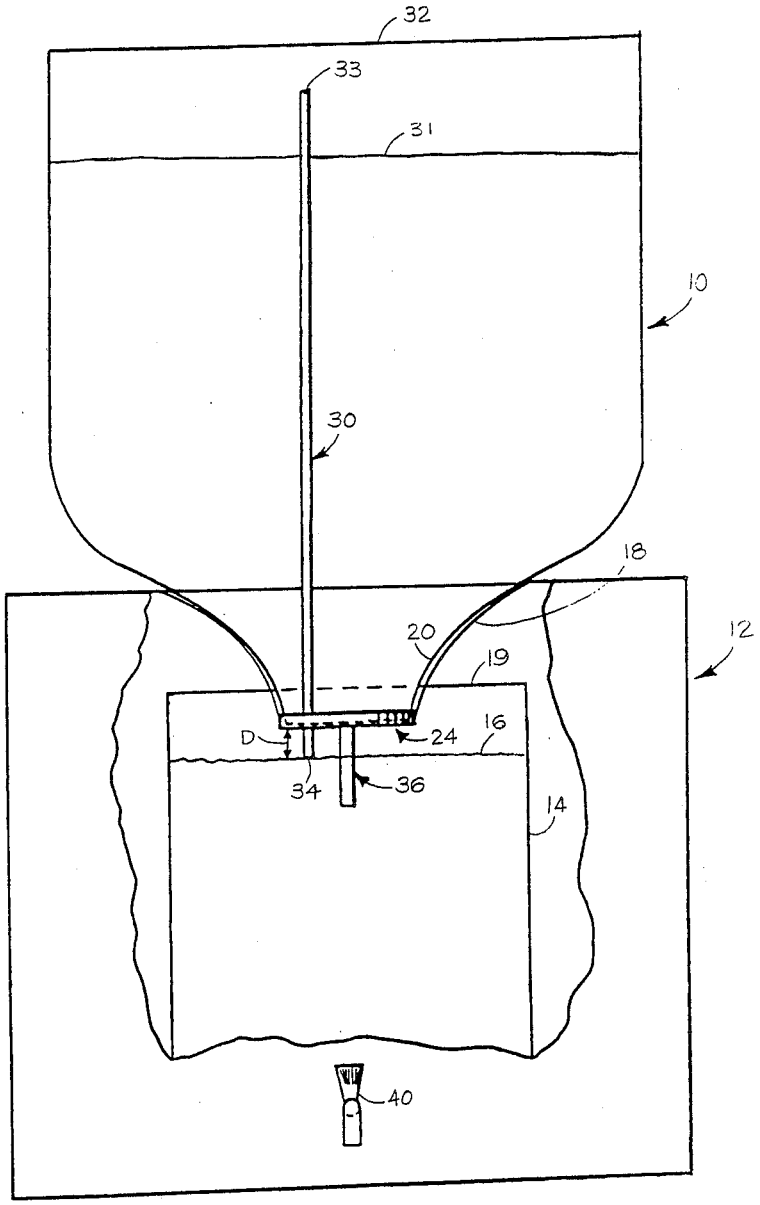
FIG. 1 is a schematic, partly cut away side plan view of the closure of the present invention connected to a water bottle which is mounted in a water cooler.

Referring now to the drawings, in FIG. 1 is shown a water bottle generally indicated by the numeral 10 which is a conventional water bottle used in a conventional water cooler generally indicated by the numeral 12 in FIG. 1. Water cooler 12 has a reservoir 14 shown in the cut-away portion of the cooler which contains water, the surface of the water being indicated at 16. The water in reservoir 14 is cooled by any conventional cooling device contained in the cooler such as conventional refrigeration equipment, ice or the like (not shown).

Cooler 12 has a tapered portion 18 for receipt of the inverted water bottle 10. Water bottle 10 has a tapered neck portion 20 which tapers down to a spout 22 shown most clearly in FIG. 2. Reservoir 14 is open at top 19 to the atmosphere.

Figure 2:
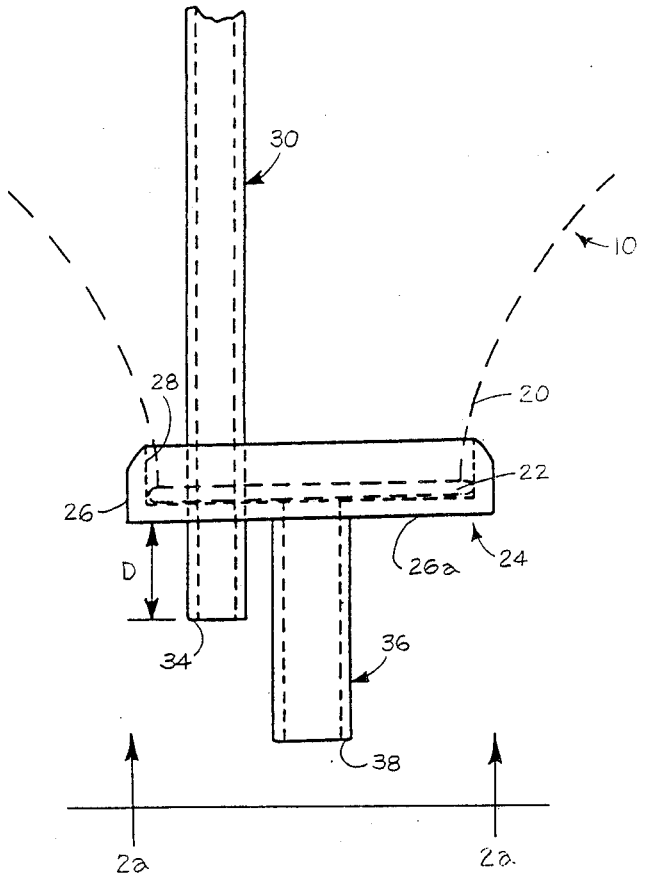
FIG. 2 is a schematic side plan view showing the closure of the present invention with a water bottle shown in phantom lines.
Figure 2A:
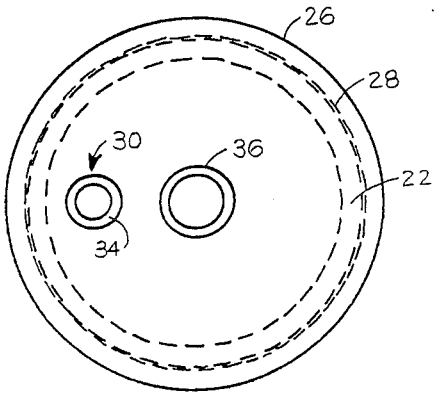
FIG. 2A is a view taken along lines 2*a*–2*a* of FIG. 2.

The closure of the present invention is generally indicated by the numeral 24 and is shown in FIG. 1 to be connected to water bottle 10, and is shown in greater detail in FIGS. 2 and 2*a*. Closure 24 includes a circular cap 26 having a hollow generally cylindrical interior 28 for receipt of spout 22 of water bottle 10. Preferably spout 22 is force fitted into closure 26.

Cap 26 has an air tube 30 which extends therethrough and upwardly therefrom to a point adjacent to the bottom 32 of bottle 10 above water level 31. It is preferred that tube 30 be as closely adjacent to bottom 32 of container 10 as possible in order to prevent any bubbling of air through water which may be located above the top end 33 of air tube 30.

As can be seen in FIGS. 1 and 2, air tube 30 preferably extends beneath the bottom 26*a* of cap 26, a distance "D". Tube 30 is extended a distance "D" beneath the bottom of cap 26*a*, so that the water level 16 in reservoir 14 will never touch the bottom of cap 26*a*. Preferably, distance "D" is about one-half inch to one inch. The water level 16 will only rise upwardly to the bottom 34 of tube 30. Thus, if there is any dirt or contamination placed on the the bottom 26*a* of closure 24 by the worker who is placing the closure on the bottle, the contamination or dirt will not come in contact with the water in reservoir 16.

Connected to cap 26 and extending therethrough is water tube 36. Water tube 36 conveys water from the interior of bottle 10 downwardly into reservoir 14 as air travels upwardly through tube 30 to the interior of the water bottle. As can be seen in FIGS. 1 and 2, it is necessary that the bottom 38 of water tube 36 be beneath the bottom 34 of air tube 30 in order for water to flow out of tube 36 rather than air bubbling upwardly through tube 36.

In operation, as water is removed from reservoir 14 by valve 40, which may be any conventional valve for removing water from a reservoir, the water level 16 will drop until the water level 16 is beneath the bottom 34 of air tube 30, at which point air will travel upwardly through air tube 30 and water will travel downwardly through water tube 36 into reservoir 14. As water travels downwardly through 36 into reservoir 14, eventually the water level 16 will rise upwardly until the bottom 34 of air tube 30 is covered by the water and air can no longer enter the interior of water bottle 10 through tube 36. At this point water will cease flowing from water bottle 10.

Thus, air travels upwardly through tube 30 and is never allowed to bubble upwardly through the water in water bottle 10, thereby reducing contamination of water in water bottle 10 by air on the exterior of the cooler. Furthermore, the bottom 32 of water bottle 10 will not flex upwardly and downwardly since there are no bubbles entering the water bottle from spout 20.

Figure 3:
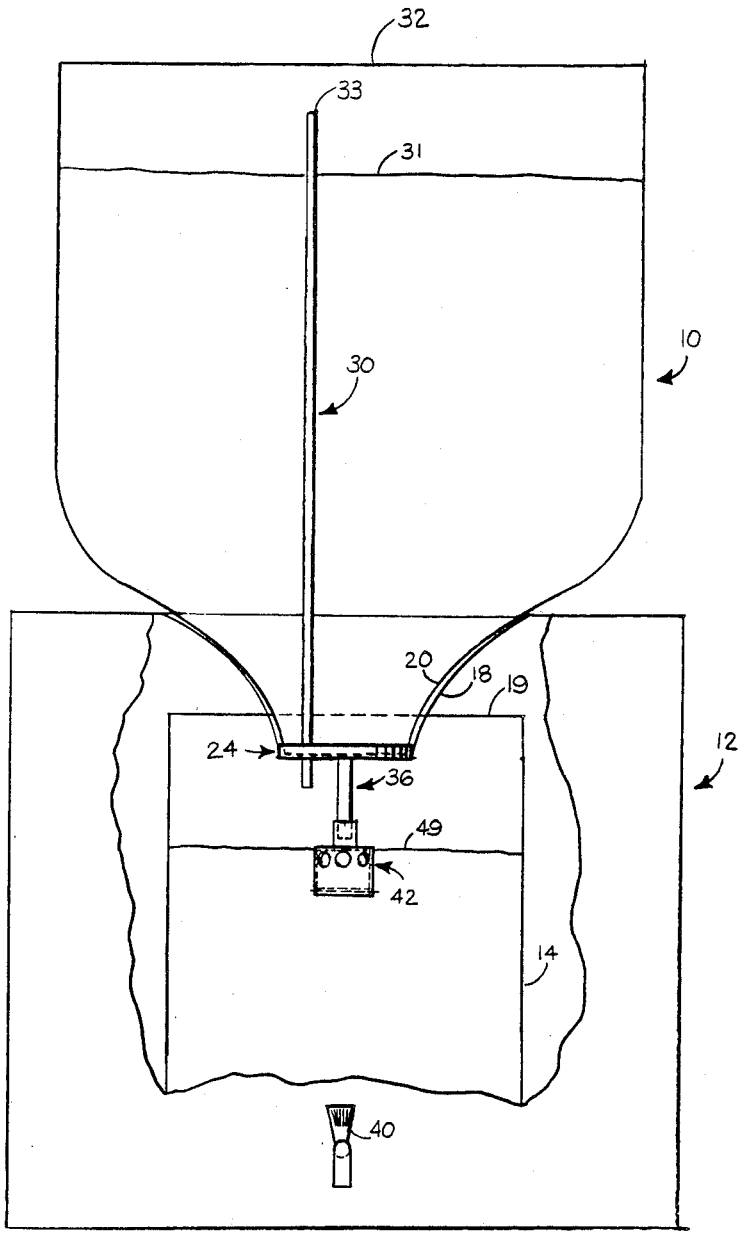
FIG. 3 is a schematic side plan view of the closure of the present invention and the float valve of the present invention connected to the closure mounted on a water bottle connected to a water cooler.
Figure 4:
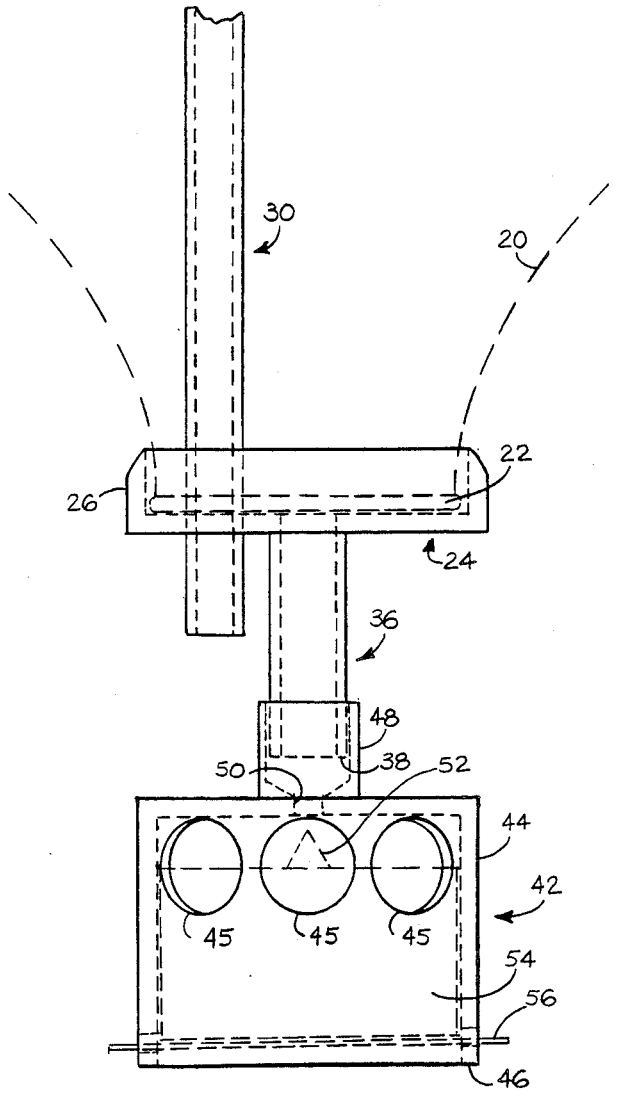
FIG. 4 is a schematic side plan view of the closure and valve of the present invention connected to a water bottle shown in phantom lines.

In FIGS. 3 and 4 is shown another embodiment of the invention in which a valve generally indicated by the numeral 42 is connected to the bottom 38 of water tube 36 to prevent water from flowing outwardly through 36 if a hole is punched in the bottom 32 or the side of container 10. Valve 42 can best be seen in FIG. 4.

Valve 42 is a cylinder 44 having holes 45 in the sides or top thereof which is open at the bottom 46 and has a hollow tube 48 in the top thereof. Tube 58 has a restricted throat 50 for receipt of a conical seal 52 connected to float 54. Seal 52 could be hemispherically shaped if desired.

Figure 4A:
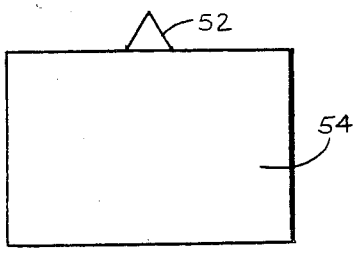
FIG. 4*a* is a side plan view of a float of the float valve of the invention.

Float 54 is a cylindrical floating material slidably received inside of cylindrical body 44 and is prohibited from dropping from the bottom of cylindrical body 44 by pin 56 or any other conventional device which is inserted into lower end of cylindrical body 44. FIG. 4*a* is a side plan view of float 54.

Tube 48 is preferably force-fitted onto tube 36. Thus, when the water level in reservoir 14 reaches the level 49 shown in FIG. 3, which is approximately the top of valve 42, float 54 floats upwardly to cause seal 52 to seat in throat 50 and seal the water tube 36 from water bottle 10 to prevent water from flowing from water bottle 10. Air normally travels upwardly into water bottle 10 through air tube 30 when there is no hole in water bottle 10.

Figure 5:
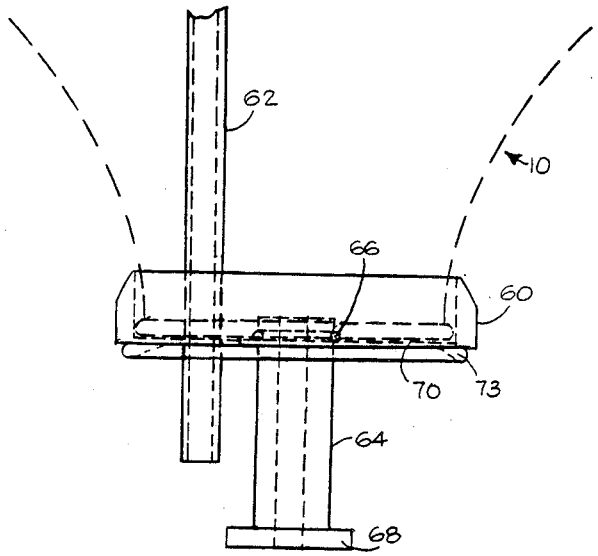
FIG. 5 is a schematic plan of another embodiment of the invention having a slidable water tube mounted on a water bottle shown in phantom lines.
Figure 6:
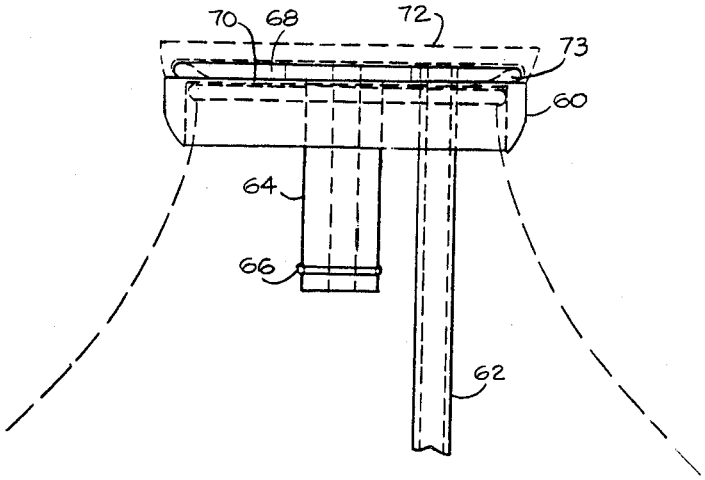
FIG. 6 is a schematic plan view of the embodiment shown in FIG. 5 having a cap thereon shown in phantom lines.

Referring now to FIGS. 5 and 6, closure 60 is shown connected to inverted water bottle 10 and has a air tube 62, and a water tube 64 similar to closure 24 shown in FIGS. 1–2*a*. Water tube 64 slides upwardly and downwardly in closure 60 when the bottle is inverted. Water tube 64 is held in closure 60 by an "O" ring 66 or other conventional device when the closure is inverted as shown in FIG. 5, and by a lip 68 which strikes a recessed portion 70 of closure 60 when the bottle is upright as shown in FIG. 6.

Thus, when shipping or storing water bottles a cap 72 may be over closure 60 as shown in FIG. 6. Closure 60 has a rounded lip 73 shown in FIG. 5 and 6 over which cap 72 may be snapped. Air tube 62 is force fitted in closure 60 can be pulled down to the position shown in FIG. 5, if desired, after cap 72 has been removed, or air tube 62 can remain in the position shown in FIG. 6. Closure 60 functions in the same manner as closure 24 shown in FIGS. 1–2*a* and water tube 62 extends upwardly to a point adjacent to the bottom of bottle 10.

Figure 7:
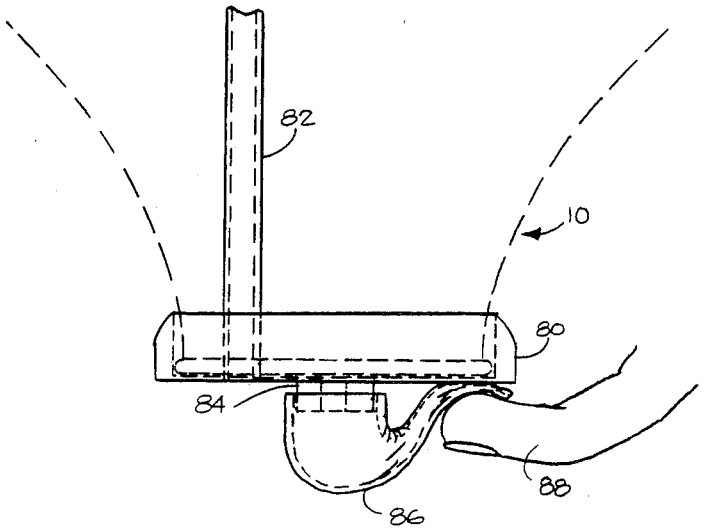
FIG. 7 is a plan view of an alternate embodiment of the invention utilizing a flexible tube to prevent water from flowing from the bottle when a bottle is inverted.
Figure 8:
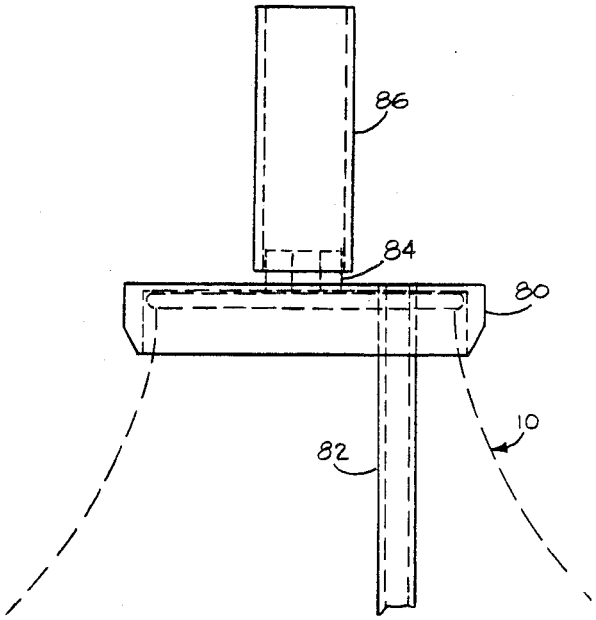
FIG. 8 is a plan view of the embodiment of FIG. 7 on an upright bottle.

In FIG. 7 is shown another embodiment of the invention. Closure 80 has a air tube 82 connected thereto and a water tube 84 connected thereto similar to closure 24 shown in FIGS. 1 through 4. However, water tube 84 has a flexible tube 86 such as surgical tubing connected thereto which can be held by the finger 88 of the person placing the water bottle 10 in the cooler as shown in FIG. 7 to prevent water from flowing out of water tube 84 and flexible tube 86, and spilling onto the floor.

When the bottle 10 is placed in the cooler, the finger 88 is released and the flexible tubing 86 will extend straight downwardly from water tube 84 allowing the closure to operate as closure 24 previously described in FIGS. 1 through 2a. If desired, water tube 84 could be replaced with flexible tube 86 which could be bonded to closure 80 by any conventional means such as gluing, force fitting, or the like.

Figure 9:
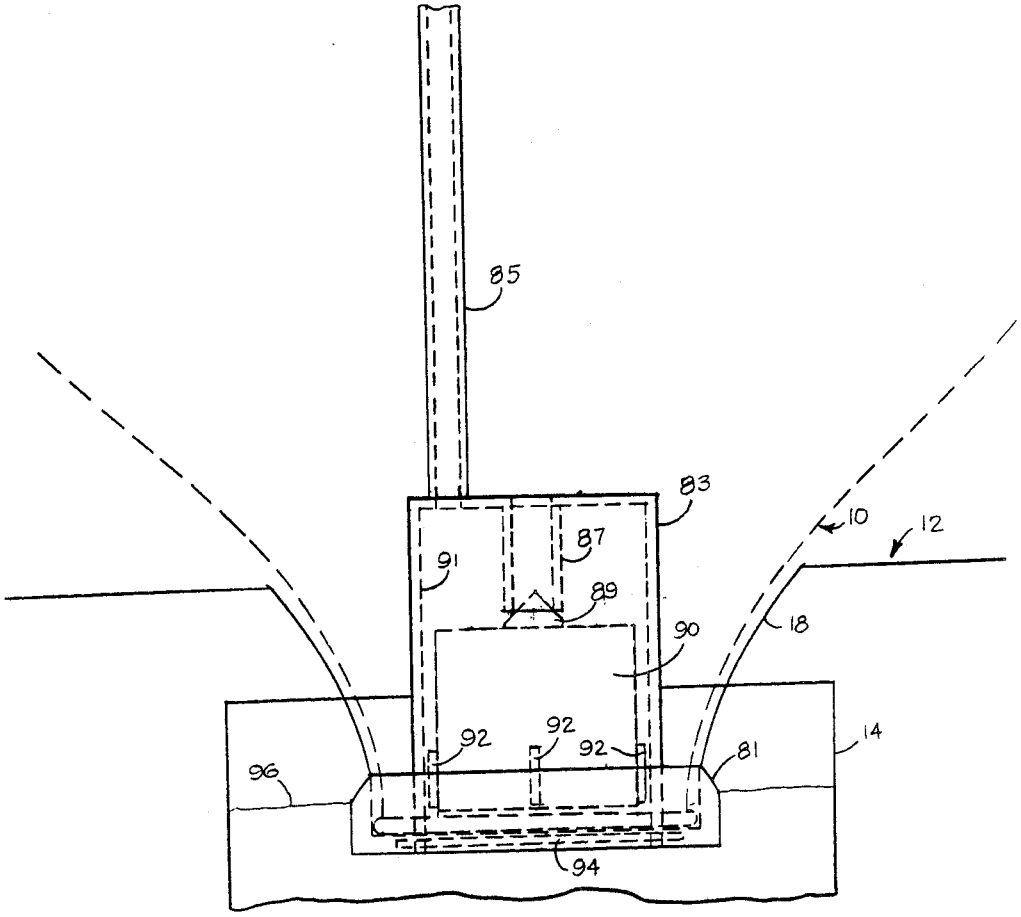
FIG. 9 is a schematic plan view of an additional embodiment of the invention employing a float valve.
Figure 10:
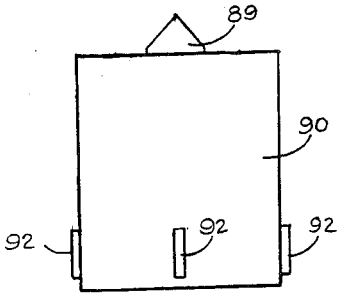
FIG. 10 is a plan view of the float of the embodiment shown in FIG. 9.

In FIGS. 9 and 10 is shown another embodiment of the invention in which a closure 81 is shown connected to inverted water bottle 10 resting in a tapered portion 18 of water cooler 12 having reservoir 14 similar to the bottle and water cooler shown in FIGS. 1 and 3 and includes a hollow cylinder 83 having connected thereto air tube 84 and water tube 87. Water tube 87 is aligned with hemispherical or conical seal 89 on cylindrical float 90.

Cylindrical float 90 is closed at the top and preferably has guides 92 thereon which provide channels therebetween through which air may flow upwardly into air tube 85 and water may flow downwardly from water tube 87 to reservoir 14. Air tube 85 extends upwardly to a point adjacent to the bottom of water bottle 10. Guides 92 could be removed from float 90 and placed on the interior walls 91 of cylinder 83 if desired. Also if desired, baffles could be provided on the top of float 90 to direct water and air flow as desired. Closure 81 is open at the bottom and has a pin 94 therein or any other conventional device for preventing float 90 from dropping out of the bottom of closure 81 when the closure is inverted as shown in FIG. 9.

The water level in reservoir 14 containing cooler 12 is indicated by the numeral 96. As water flows downwardly through tube 87 the water level will eventually will reach a point in reservoir 14 of cooler 12 at which float 90 will float upwardly to a point where seal 89 will enter the bottom of water tube 87 as shown in FIG. 9 and stop the water flow from tube 87.

As water is drained from the reservoir 14 through a valve such as valve 40 shown in FIG. 1, the water level will drop until air will enter the bottom of the closure and travel upwardly between the outside of float 90 and the inside of walls 91 of cylinder 83 upwardly through air tube 85. At the same time water will travel downwardly through tube 87 since float 89 will be in the down position resting on pin 94.

Thus, air will be traveling upwardly through tube 85 at the same time water is traveling downwardly through tube 87 and downwardly into reservoir 14 between the outside of float 90 and the inside walls 91 of cylinder 83. When the water level 96 in reservoir 14 again rises sufficiently, the float 90 will move upwardly and seal 89 will seal off water flow from water tube 87.

When the bottle 10 is inverted as shown in FIG. 9 prior to placement into cooler 12, only a small amount of water can flow out of tube 87 and around float 90. Thus, the amount of water which is spilled when loading a bottle into a water cooler 12 is minimized by closure 81. Furthermore, since all of the cylinder 83 is contained inside the bottle above closure 81, a cap or seal may be placed on closure 81 curing transport and storage of water bottles.

In all embodiments of the invention, when the water bottle is inverted and the closure placed thereon, the bottom of the water tube should be beneath the bottom of the air tube so that air will travel up the air tube rather than bubbling upwardly through the water in the bottle.

Although the preferred embodiments of the present invention have been disclosed and described in detail above, it should be understood that the invention is in no sense limited thereby, and its scope is to be determined by that of the following claims.

What is claimed is:

1. A closure assembly for conveying air to the interior of an inverted water bottle and for conveying water from the interior of an inverted water bottle having a downwardly pointing spout comprising:

a. closure means connectable to the spout of said water bottle, said closure means having an opening therein through which water may flow from said inverted water bottle, b. hollow cylinder means having an open first end and a partially closed second end, said first end being connected to said closure means, said second end being located in the interior of said water bottle and having an air inlet open to said hollow cylinder means for conveying air from the interior of said hollow cylinder means to the interior of said water bottle, said second end also having a water inlet open to said hollow cylinder means for conveying water from the interior of the inverted water bottle to the interior of said hollow cylinder means, said closure means having an opening therein in alignment with said first end of said hollow cylinder means, and c. float means slidably received in said hollow cylinder means for sealing said water inlet while said air inlet remains open to said hollow cylinder means.

2. The closure assembly of claim 1 wherein said hollow cylinder means is contained inside said water bottle.

3. The closure assembly of claim 1 wherein said float means is generally cylindrical in shape and has seal means on the top thereof for contacting said water inlet to prevent the flow of water therefrom.

4. The closure assembly of claim 3 wherein said float means has cylindrical walls having guide means thereon which form channels between the interior walls of said hollow cylinder means through which air and water can flow.

5. The closure assembly of claim 1 wherein said water bottle has a top end and a bottom end, said spout being located on said top end, said air inlet has a tube means connected thereto for conveying air from said air inlet to the interior of said water bottle, said tube means having an inlet end connected to said air inlet and an outlet end located in the interior of said water bottle adjacent to the bottom of said water bottle.

6. The closure assembly of claim 5 wherein said water inlet in said second end of said hollow cylinder means has hollow tube means extending from said water inlet means into the interior of said hollow cylinder means.

7. The closure assembly of claim 1 wherein said closure means is generally cylindrical in shape.

8. The closure assembly of claim 7 wherein said closure means is adapted to receive and connect to the spout of said water bottle.

9. The closure assembly of claim 8 wherein said hollow cylinder means has pin means therein to prevent said float means from falling from said cylinder means.

* * * * *